US006371667B1

(12) United States Patent
Kitano et al.

(10) Patent No.: US 6,371,667 B1
(45) Date of Patent: Apr. 16, 2002

(54) FILM FORMING METHOD AND FILM FORMING APPARATUS

(75) Inventors: Takahiro Kitano; Masami Akimoto; Tomohide Minami, all of Kumamoto; Masateru Morikawa, Mashiki-Machi, all of (JP)

(73) Assignee: Tokyo Electron Limited, Tokyo (JP)

( * ) Notice: Subject to any disclaimer, the term of this patent is extended or adjusted under 35 U.S.C. 154(b) by 0 days.

(21) Appl. No.: 09/545,003

(22) Filed: Apr. 6, 2000

(30) Foreign Application Priority Data

Apr. 8, 1999 (JP) ..... 11-101539

(51) Int. Cl.[7] ..... G03D 5/00

(52) U.S. Cl. ..... 396/611; 396/627; 118/52; 427/240

(58) Field of Search ..... 396/604, 611, 396/627; 118/52, 316, 319, 320, 500, 712; 430/311, 313; 427/240, 425, 422, 385; 134/33, 2–4, 157, 172, 902

(56) References Cited

U.S. PATENT DOCUMENTS 4,416,213 A * 11/1983 Sakiya ..... 118/52
4,451,507 A * 5/1984 Beltz et al. ..... 427/240
5,571,560 A * 11/1996 Lin ..... 427/240
5,658,615 A 8/1997 Hasebe et al. ..... 427/240
5,821,035 A * 10/1998 Hirano et al. ..... 430/311
5,928,425 A * 7/1999 Lee ..... 118/712
5,962,070 A * 10/1999 Mitsuhashi et al. ..... 427/240
6,048,400 A * 4/2000 Ohtani ..... 118/688
6,139,634 A * 10/2000 Naka et al. ..... 118/52
6,324,692 B1 * 5/2001 Shin ..... 396/611

FOREIGN PATENT DOCUMENTS

JP 04-209520 A * 1/1992
JP 05-82433 A * 4/1993
JP 09-213625 A * 8/1997
JP 11-162817 A * 6/1999

* cited by examiner

*Primary Examiner*—D Rutledge
(74) *Attorney, Agent, or Firm*—Radar, Fishman & Grauer, PLLC

(57) ABSTRACT

A resist solution discharge nozzle for discharging a resist solution to a wafer is moved at a constant speed along a radial direction of the wafer while the wafer is being rotated. During this movement, the amount of the resist solution to be discharged from the resist solution discharge nozzle is gradually decreased. The resist solution discharged to the wafer is applied to the front surface of the wafer drawing a spiral track, and coating amounts of the resist solution per unit area with respect to a central portion and a peripheral portion of the wafer can be made equal. Accordingly, waste of a processing solution supplied onto a substrate can be eliminated, and a uniform processing solution film can be formed on the substrate.

6 Claims, 15 Drawing Sheets

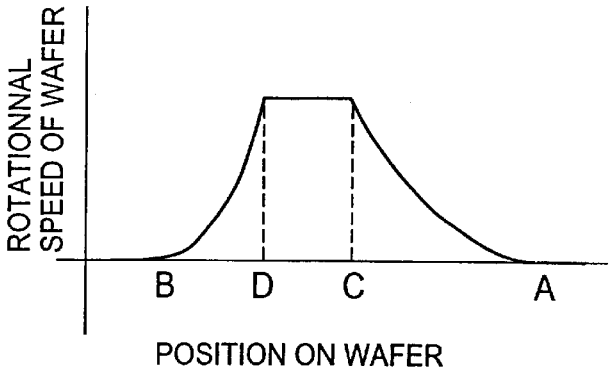
FIG.21
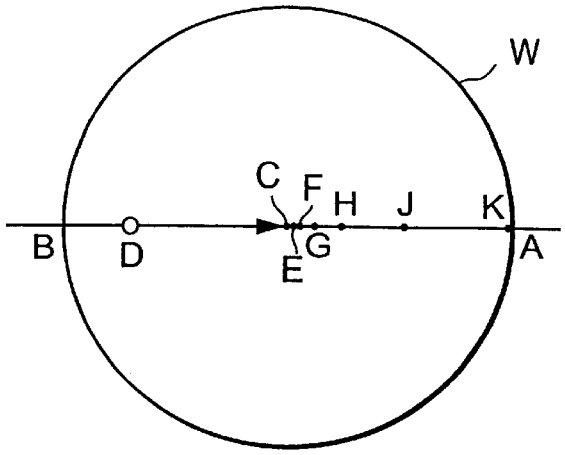
FIG.22
| TRANSIT POINT ON WAFER | E | F | G | H | J | K | A |
|---|---|---|---|---|---|---|---|
| MOVING SPEED OF NOZZLE (mm/sec) | 32 | 16 | 8 | 4 | 2 | 1 | 0 |
| ROTATIONAL SPEED OF WAFER (rpm) | 1920 | 960 | 480 | 240 | 120 | 60 | |
FIG.23

FILM FORMING METHOD AND FILM FORMING APPARATUS

BACKGROUND OF THE INVENTION

1. Field of the Invention

The present invention relates to a film forming method and a film forming apparatus each for supplying a processing solution to a substrate to form a film of the processing solution.

2. Description of the Related Art

A lithography process in semiconductor device fabrication, for example, has various processing steps such as a resist coating processing step of applying a resist solution to the front surface of a semiconductor wafer (hereinafter referred to as "a wafer") or the like, an exposure processing step of exposing the wafer after resist coating processing, a developing processing step of developing the wafer after exposure processing, and the like. A spin coating method is adopted, for example, in the resist coating processing step.

In this spin coating method, a predetermined amount of resist solution is dropped to a central portion of the wafer, the wafer is then rotated, and thus the resist solution at the central portion is spread over the wafer by centrifugal force to form a resist film.

Incidentally, it is required to form a uniform resist film on the front surface of the wafer for improving yield of products. Therefore, in the conventional spin coating method, the wafer is rotated at a high speed, and thus the resist solution is spread by centrifugal force, which allows the resist solution to fully spread to a peripheral portion of the wafer.

When the wafer is rotated at a high speed as described above, however, the resist solution scattered from the front surface of the wafer increases in amount, thus causing waste. If the wafer is rotated at a low speed in order to prevent the above waste, the applied resist solution can not fully spread to the peripheral portion of the wafer, and consequently a uniform resist film can not be formed.

SUMMARY OF THE INVENTION

An object of the present invention is to provide a film forming method and a film forming apparatus capable of decreasing the amount of processing solution by eliminating the aforesaid waste and forming a uniform processing solution film on a substrate.

To attain the above object, a first aspect of the present invention is a method for forming a film of a processing solution on a substrate, comprising the steps of rotating the substrate, supplying the processing solution discharged from a nozzle onto the rotating substrate, moving a position on the substrate of the processing solution to be supplied from the nozzle nearly in a radial direction of the rotating substrate, and performing control such that the processing solution to be supplied onto the substrate is uniform.

According to the present invention, if the processing solution is discharged to the rotating substrate from the nozzle which moves at a constant speed along the radial direction of the substrate, for example, the processing solution is supplied to the substrate drawing a spiral track. In this situation, if the supply amount of the processing solution is gradually decreased from a peripheral portion of the substrate to a central portion of the substrate, for example, the processing solution can be supplied uniformly onto the substrate. Consequently, it becomes unnecessary to spread the processing solution by centrifugal force, a uniform processing solution film can be formed even if the wafer is rotated at a low speed, and scattering of the processing solution from the substrate can be prevented.

These objects and still other objects and advantages of the present invention will become apparent upon reading the following specification when taken in conjunction with the accompanying drawings.

BRIEF DESCRIPTION OF THE DRAWINGS

FIG. 21 is an explanatory view showing a rotational speed of the wafer at each point on the wafer in another control example of the rotational speed of the wafer when the resist solution discharge nozzle is moved on the diameter of the wafer;

FIG. 22 is an explanatory view for explaining a coating method of the resist solution according to another embodiment of the present invention;

FIG. 23 is a table showing the relation between a moving speed of the resist solution discharge nozzle and a rotational speed of the wafer at each point on the wafer in FIG. 22;

DETAILED DESCRIPTION OF THE PREFERRED EMBODIMENT

Figure 1:
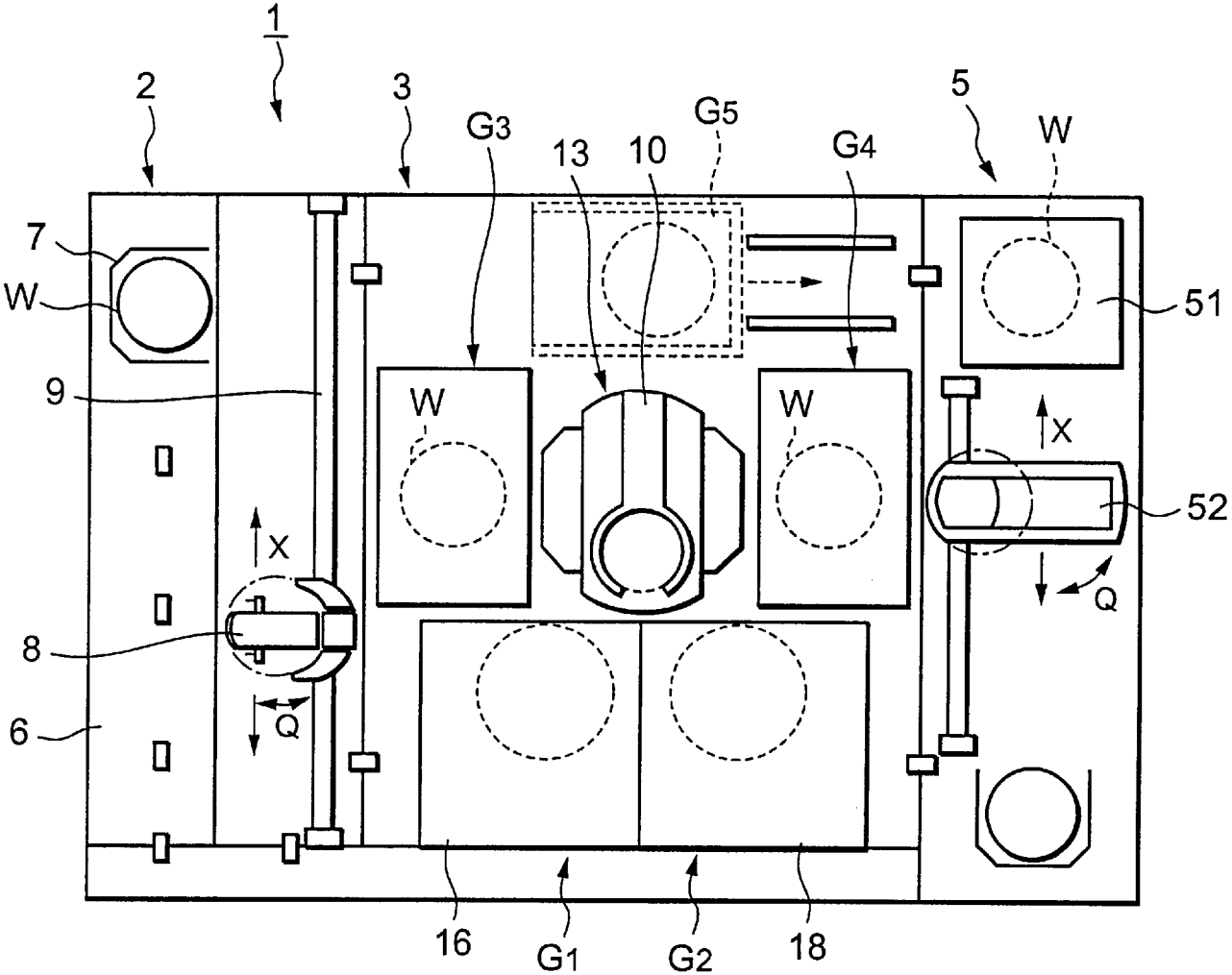
FIG. 1 is a schematic plan view of a coating and developing apparatus according to an embodiment of the present invention.
Figure 2:
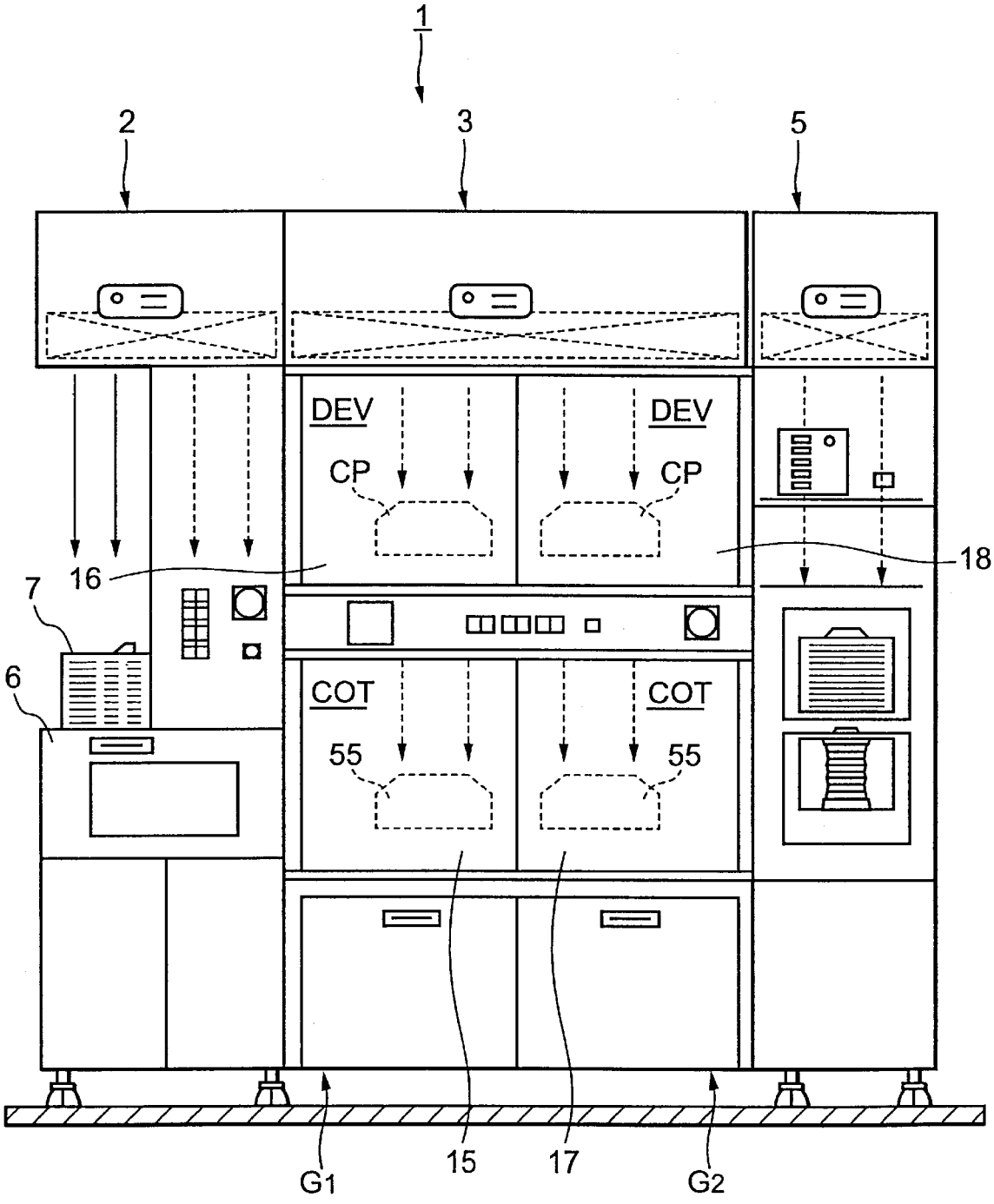
FIG. 2 is a front view of the coating and developing apparatus in FIG. 1.
Figure 3:
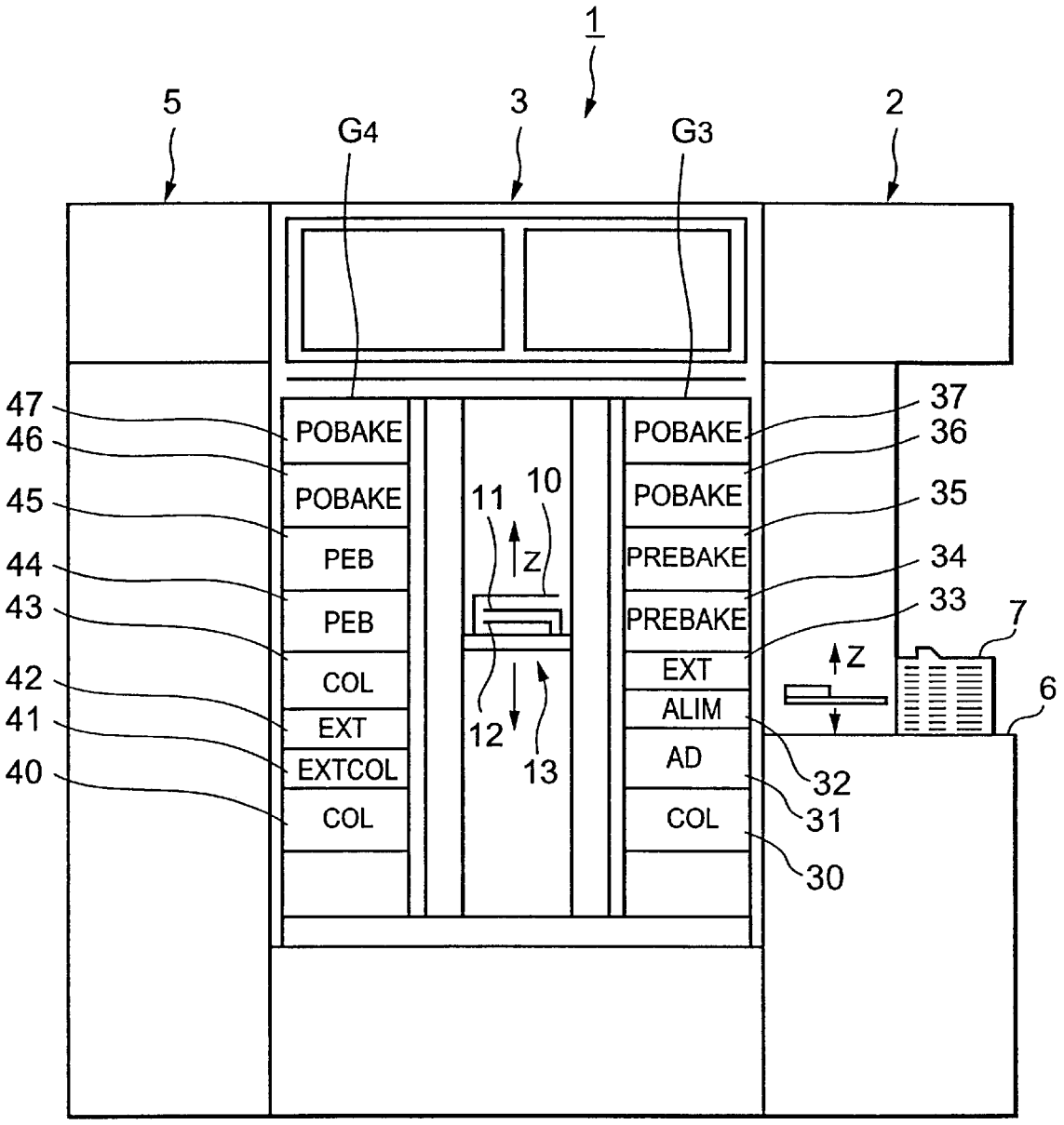
FIG. 3 is a rear view of the coating and developing apparatus in FIG. 1.

FIG. 1 to FIG. 3 show the appearance of a coating and developing apparatus according to an embodiment of the present invention. FIG. 1 is a plan view, FIG. 2 is a front view, and FIG. 3 is a rear view.

As shown in FIG. 1, a coating and developing apparatus 1 has a structure in which a cassette station 2 for transferring, for example, 25 wafers W per cassette, as a unit, from/to the outside into/from the coating and developing apparatus 1 and carrying the wafer W into/out of a cassette, a processing station 3 in which various kinds of processing units each for performing predetermined processing for the wafers W one by one in coating and developing processes are multi-tiered, and an interface section 5 for transferring the wafer w to/from an aligner (not illustrated) provided adjacent to the processing station 3 are integrally connected.

In the cassette station 2, a plurality of cassettes 7 can be freely mounted with respective transfer ports for the wafer W facing the side of the processing station 3 at predetermined positions on a cassette mounting table 6 in a line in an X-direction (a vertical direction in FIG. 1). A wafer transfer body 8 movable in the direction of arrangement of the cassettes (the X-direction) and in the direction of arrangement of the wafers W housed in the cassette 7 (a Z-direction; a vertical direction) is movable along a transfer path 9 and selectively accessible to each of the cassettes 7.

The wafer transfer body 8 is also structured to be rotatable in a θ-direction (a direction of rotation around a Z-axis) so as to be accessible to an alignment unit 32 and an extension unit 33 which are included in a third processing unit group G3 on the processing station 3 side as will be described later.

In the processing station 3, a main transfer device 13 provided with three tweezers 10, 11, and 12 for holding the wafer W respectively at the upper, middle, and lower positions is disposed in the center thereof. Around the main transfer device 13, various kinds of processing units are multi-tiered to compose processing unit groups. In the coating and developing apparatus 1, four processing unit groups G1, G2, G3, and G4 can be arranged. The first and second processing unit groups G1 and G2 are arranged on the front side of the coating and developing apparatus 1, the third processing unit group G3 is arranged adjacent to the cassette station 2, and the fourth processing unit group G4 is arranged adjacent to the interface section 5. Moreover, a fifth processing unit group G5 can be arranged on the rear side as required.

As shown in FIG. 2, in the first processing unit group G1, two kinds of spinner-type processing units, for example, a resist coating unit 15 for applying a resist solution to the wafer W and processing it and a developing unit 16 for supplying a developing solution to the wafer W and processing it are two-tiered from the bottom in order. In the second processing unit group G2, a resist coating unit 17 which has basically the same structure as the resist coating unit 15 and a developing unit 18 which has basically the same structure as the developing unit 16 are two-tiered from the bottom in order.

As shown in FIG. 3, in the third processing unit group G3, oven-type processing units in each of which the wafer W is placed on a mounting table to undergo predetermined processing, for example, a cooling unit 30 for performing cooling processing, an adhesion unit 31 for enhancing adherence of the resist and the wafer W, an alignment unit 32 for aligning the wafer W, an extension unit 33 for making the wafer W stand by, pre-baking units 34 and 35 each for performing heat processing before exposure processing, and post-baking units 36 and 37 each for performing heat processing after developing processing are eight-tiered from the bottom in order.

In the fourth processing unit group G4, for example, a cooling unit 40, an extension and cooling unit 41 for naturally cooling the mounted wafer W, an extension unit 42, a cooling unit 43, post-exposure baking units 44 and 45 for performing heat processing after exposure processing, and post-baking units 46 and 47 are eight-tiered from the bottom in order.

The interface section 5 is provided with a peripheral aligner 51 for exposing a peripheral portion of the wafer W and a wafer transfer body 52. The wafer transfer body 52 is formed to be movable in the X-direction (the vertical direction in FIG. 1) and the Z-direction (the vertical direction) and rotatable in the θ-direction (the direction of rotation around the Z-axis) so as to be accessible to the aligner (not illustrated), the extension and cooling unit 41, the extension unit 42, and the peripheral aligner 51.

The coating and developing apparatus 1 is structured as above. Next, the structure of the resist coating unit 15 for carrying out a resist film forming method according to the embodiment of the present invention will be explained.

Figure 4:
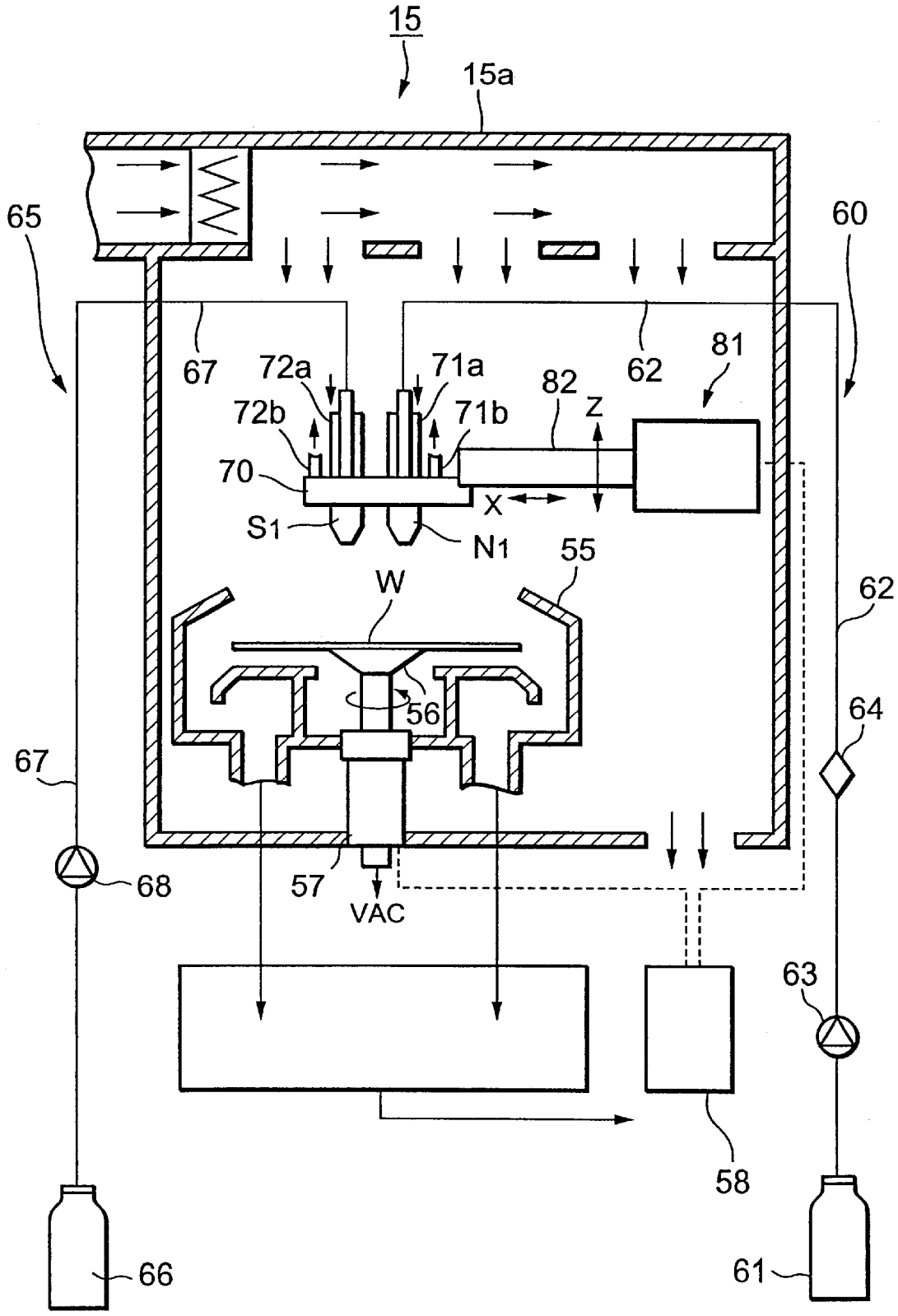
FIG. 4 is a schematic explanatory view of a resist coating unit shown in FIG. 1.

As shown in FIG. 4, the resist coating unit 15 has a cup 55 which can freely house the wafer W inside a casing 15*a*. Inside the cup 55, a spin chuck 56 for horizontally holding the vacuum-sucked wafer W and a motor 57 for rotating the spin chuck 56 are provided. The rotational frequency of the motor 57 is controlled to be an optional rotational frequency by a controller 58, whereby the wafer W is rotatable at the optional rotational frequency.

Provided above the cup 55 are a resist solution supply means 60 for applying a resist solution to the wafer W and a solvent supply means 65 for supplying a solvent for the resist solution (hereinafter referred to as "a solvent") to the wafer W.

The resist solution supply means 60 has a resist solution tank 61 for supplying the resist solution, a resist solution discharge nozzle N1 for discharging the resist solution to the wafer W, and a resist solution supply tube 62 through which the resist solution supplied from the resist solution tank 61 flows. Midway in the resist solution supply tube 62, a pump 63 such as a bellows pump, a diaphragm type pump, or the like and a filter 64 are provided from the upstream side.

The solvent supply means 65 has a solvent tank 66 for supplying the solvent, a solvent discharge nozzle S1 for discharging the solvent to the wafer W, and a solvent supply tube 67 through which the solvent supplied from the solvent tank 66 flows. Midway in the solvent supply tube 67, a pump 68 is provided.

The resist solution discharge nozzle N1 and the solvent discharge nozzle S1 are held by a common nozzle holder 70, and the nozzle holder 70 is provided with entrance paths 71*a* and 72*a* and exit paths 71*b* and 72*b* which are composed of tubes through which a temperature control fluid, for example, temperature control water or the like circulates. The temperature of the resist solution flowing through the resist solution supply tube 62 is controlled at a predetermined temperature by the temperature control water circulating through the entrance path 71*a* and the exit path 71*b*, and the temperature of the solvent flowing through the solvent supply tube 67 is controlled at a predetermined temperature by the temperature control water circulating through the entrance path 72*a* and the exit path 72*b*.

Figure 5:
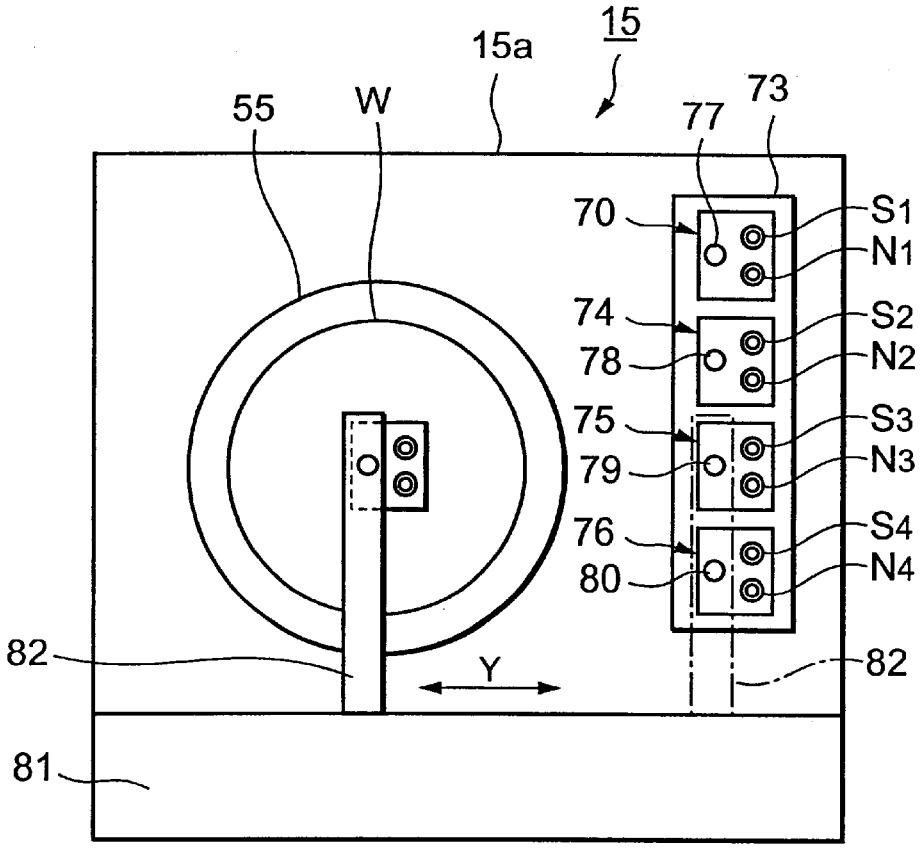
FIG. 5 is a plan view of the resist coating unit in FIG. 4.

As shown in FIG. 5, the nozzle holder 70 is held inside a holding mechanism 73 disposed outside the cup 55. Nozzle holders 74, 75, and 76 which have basically the same structure as the nozzle holder 70 are provided also in the holding mechanism 73. These holders 74, 75, and 76 hold resist solution discharge nozzles N2 to N4 and solvent discharge nozzles S2 to S4 respectively in pairs, and allows resist solutions from resist solution tanks (not illustrated) independent of one another to be discharged from the corresponding resist solution discharge nozzles N2 to N4. Hence, in this embodiment, four kinds of different resist solutions can be supplied to the wafer W.

The diameters of discharge ports of the resist solution discharge nozzles N2 to N4 are preferably between 10 μm and 500 μm, and more preferably about 135 μm. This is because the flow rate of the resist solution is excessively low when the diameter is less than 10 μm. Meanwhile, when the diameter is more than 500 μm, the resist solution drips from the resist solution discharge nozzle, which makes the control of flow rate impossible. Moreover, when kinds of resist solutions are different, it is preferable that the diameters of the discharge ports of the resist solution discharge nozzles N2 to N4 are changed depending on viscosity of the respective resist solutions. For example, when the viscosity of a resist solution is high, it is preferable that the diameter is made larger as compared with a case where the viscosity of the resist solution is low.

The nozzle holders 70, 74, 75, and 76 are provided with holding pins 77, 78, 79, and 80, respectively. The holding pins 77, 78, 79, and 80 are held by a scan arm 82 of a scan mechanism 81. The scan arm 82 is structured to be movable in three dimensions, that is, in the X-direction, the Y-direction, and the Z-direction. The moving speed of the scan arm 82 is appropriately controlled by the controller 58. Accordingly, the nozzle holders 70, 74, 75, and 76 are movable in three dimensions by the scan mechanism 81, and the moving speed during the movement is controlled by the controller 58 as will be described later.

The resist coating unit 15 is structured as above. Next, the resist film forming method according to the embodiment of the present invention will be explained.

The wafer W for which predetermined heating processing is completed in the pre-baking unit 34 is transferred to the resist coating unit 15, and thereafter suction-held on the spin chuck 56. A resist solution to be used is selected, and the scan arm 82 moves to get a nozzle holder provided with a resist solution discharge nozzle NX capable of discharging the selected resist solution. In this case, if the resist solution discharge nozzle N1 is selected, for example, the scan arm 82 gets the nozzle holder 70.

The nozzle holder 70 stops at a predetermined position above the cup 55 while being held by the scan arm 82, and a solvent is discharged from the solvent discharge nozzle S1 to a central portion of the wafer W in the first place. The discharged solvent is spread over the front surface of the wafer W by rotation of the wafer W.

Figure 6:
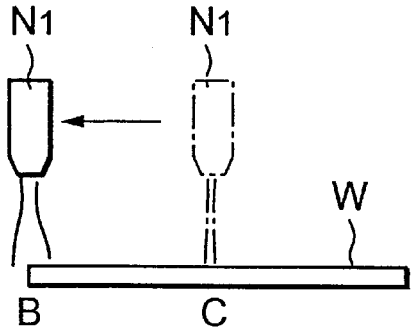
FIG. 6 is an explanatory view showing a state in which a resist solution discharge nozzle in the resist coating unit is moved from a central portion to a peripheral portion of a wafer.
Figure 7:
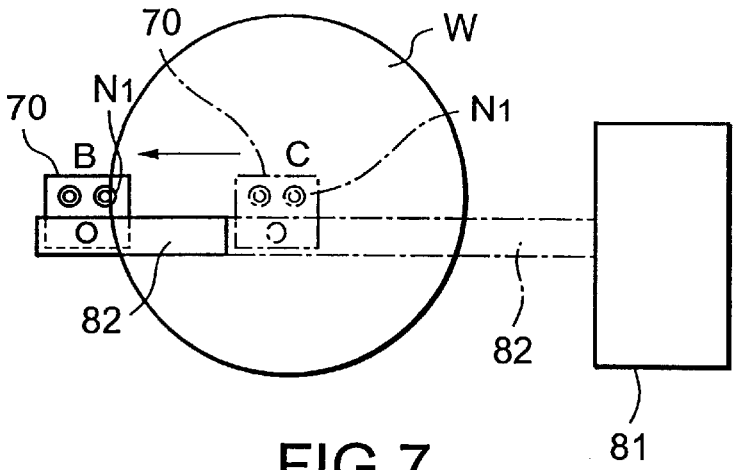
FIG. 7 is an explanatory view showing the state in FIG. 6 in plan view.
Figure 8:
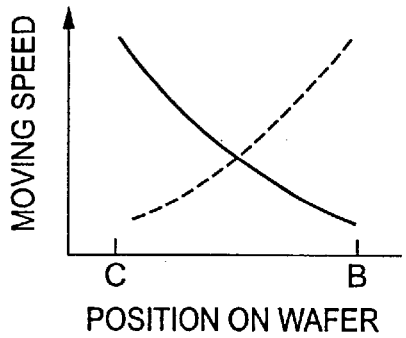
FIG. 8 is a graph showing the relation between a position on the wafer of the resist solution discharge nozzle and a moving speed.
Figure 9:
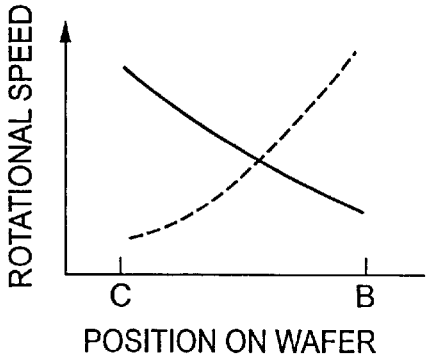
FIG. 9 is a graph showing the relation between a position on the wafer of the resist solution discharge nozzle and a rotational speed.

Subsequently, the nozzle holder 70 is moved along a radial direction of the wafer W by the scan mechanism 81 while the wafer W is being rotated, and the resist solution discharge nozzle N1 is moved from a central portion C of the wafer W to a peripheral portion B of the wafer W as shown in FIG. 6 and FIG. 7. As shown by a full line in FIG. 8, the moving speed thereof is gradually decreased while the resist solution discharge nozzle N1 is moved from the central potion C of the wafer W to the peripheral portion B of the wafer W. As shown by a full line in FIG. 9, the rotational speed of the wafer w is gradually decreased while the resist solution discharge nozzle N1 is moved from the central potion C of the wafer W to the peripheral portion B of the wafer W.

Figure 10:
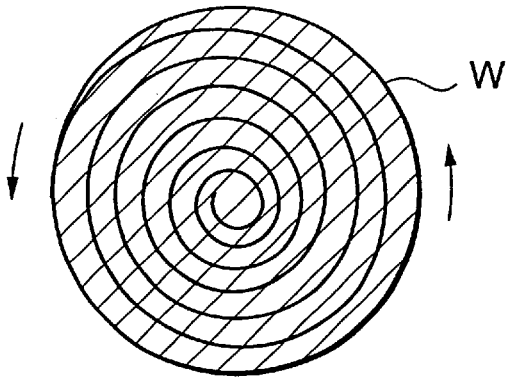
FIG. 10 is an explanatory view showing a state in which a resist solution is applied to the wafer from the resist solution discharge nozzle.
Figure 11:
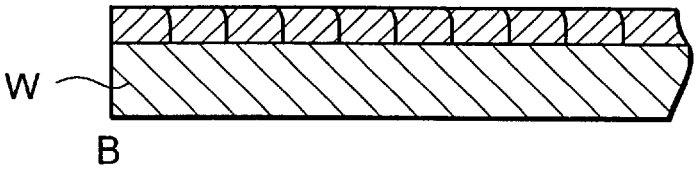
FIG. 11 is a sectional explanatory view showing the wafer coated with the resist solution in FIG. 10 in side view.
Figure 12:
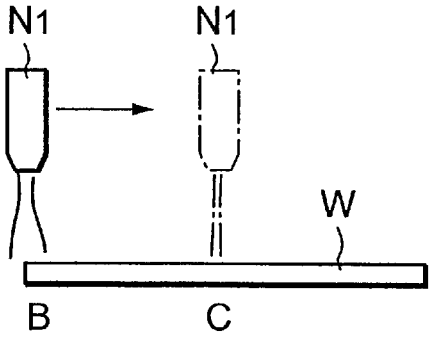
FIG. 12 is an explanatory view showing a state in which the resist solution discharge nozzle is moved from the peripheral portion to the central portion of the wafer.
Figure 13:
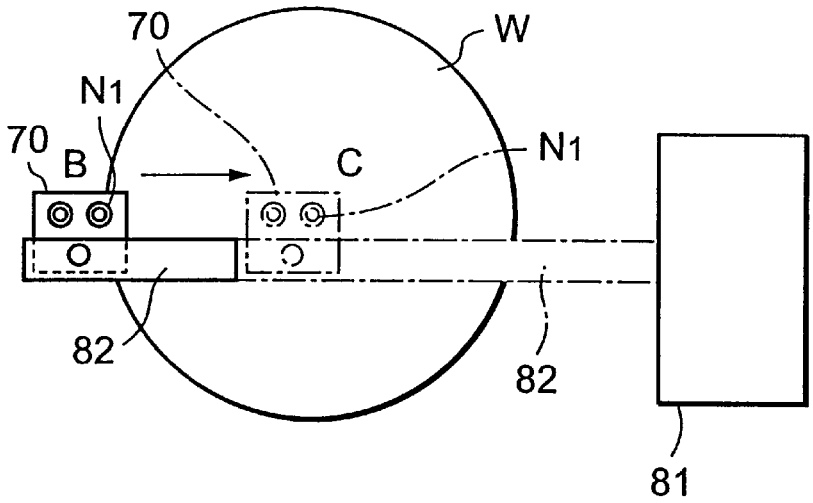
FIG. 13 is an explanatory view showing the state in FIG. 12 in plan view.

In this case, the resist solution discharged from the resist solution discharge nozzle N1 is applied drawing a spiral track as shown in FIG. 10. The moving speed of the resist solution discharge nozzle N1 and the rotational speed of the wafer W are gradually decreased from the central portion C to the peripheral portion B, whereby supply amounts of the resist solution per unit area supplied to the central portion C and the peripheral portion B can be made equal. Moreover, since the resist solution is applied drawing a spiral track, even if the resist solution is not applied uniformly to the wafer W at first, the applied resist solution is thereafter spread uniformly all over the wafer W by the fluidity of the applied resist solution and the rotation of the wafer W. As a result, a uniform resist film can be formed on the wafer W as shown in FIG. 11 even if the resist solution is not spread to the peripheral portion of the wafer W by centrifugal force by rotating the wafer W at a high speed. Further, since the wafer W is not rotated at a high speed, scattering of the resist solution can be prevented. Furthermore, drying of the resist solution can be made more uniform especially by starting the supply of the resist solution from the central portion C of the wafer W. This is because the circumferential speed is lower and thus drying is slower at a position moving closer to the central portion. As shown in FIG. 12 and FIG. 13, however, the resist solution discharge nozzle N1 may be moved from the peripheral portion B of the wafer W to the central portion C of the wafer W. In this case, as shown by dotted lines in FIG. 8 and FIG. 9, the moving speed of the resist solution discharge nozzle N1 and the rotational speed of the wafer W are gradually increased while the resist solution discharge nozzle N1 is moved from the peripheral portion B of the wafer W to the central portion C of the wafer W.

Although both the moving speed of the nozzle and the rotational speed of the wafer W are controlled in the aforesaid example, it is naturally suitable that either one is controlled.

Figure 14:
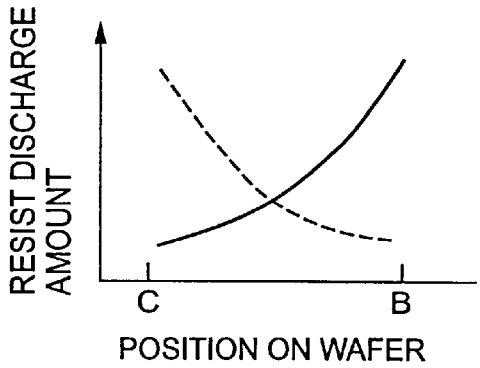
FIG. 14 is a graph showing the relation between a position on the wafer of the resist solution discharge nozzle and a discharge amount of the resist solution.
Figure 15:
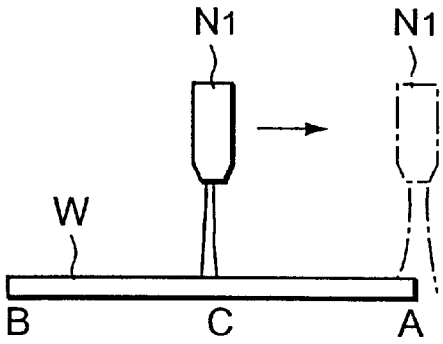
FIG. 15 is an explanatory view showing a state in which the resist solution discharge nozzle is moved further to a peripheral portion on a diameter of the wafer.

It is also suitable to control the discharge amount of the resist solution instead of controlling the moving speed of the nozzle and the rotational speed of the wafer W. For example, during the movement of the resist solution discharge nozzle N1 from the central portion C to the peripheral portion B of the wafer W, that is, during the movement in the radial direction, the resist solution is discharged from the resist solution discharge nozzle N1 to the wafer W, and the discharge amount thereof is gradually increased as the resist solution discharge nozzle N1 moves from the central portion C to the peripheral portion B as shown by a full line in FIG. 14. When the resist solution discharge nozzle N1 is moved from the peripheral portion B to the central portion C of the wafer W, the discharge amount thereof is gradually decreased as the resist solution discharge nozzle N1 moves from the peripheral portion B to the central portion C as shown by a dotted line in FIG. 14.

Incidentally, the resist solution discharge amount from the resist solution discharge nozzle N1 can be increased or decreased by increasing or decreasing the feed amount of the resist solution from the pump 63. When the pump 63 is a bellows pump or a diaphragm type pump, for example, the forcing amount is controlled by a stepping motor, and the feed amount of the resist solution from the pump 63 can be increased by raising a pulse transmission value to the stepping motor.

Moreover, it is suitable that the resist solution discharge nozzle N1 which is moved from the peripheral portion B to the central portion C at a constant speed is continuously moved further to a peripheral portion A at a constant speed, and that the discharge amount of the resist solution for the wafer W is gradually increased during the movement of the resist solution discharge nozzle N1 at a constant speed from the central portion C to the peripheral portion A.

In this case, while the resist solution discharge nozzle N1 is moved from the central portion C to the peripheral portion A at a constant speed, the resist solution is applied onto the rotating wafer W drawing a spiral track. Therefore, the resist solution is applied spirally onto the wafer W on two separate occasions in all, the first time is while the resist solution discharge nozzle N1 is moved from the peripheral portion B to the central portion C at a constant speed, and the second time is while it is moved from the central portion C to the peripheral portion A. Consequently, coating unevenness of the resist solution can be reduced more than in the aforesaid case.

The supply amount of the resist solution is gradually increased while the resist solution discharge nozzle N1 is moved from the central portion C to the peripheral portion A, thereby making a resist solution coating amount per unit area equal between the central portion C and the peripheral portion A. As a result, a uniform resist film can be formed on the wafer W.

The rotational direction of the wafer W is reversed between the movement of the resist solution discharge nozzle N1 from the peripheral portion B to the central portion C and the movement thereof from the central portion C to the peripheral portion A, whereby a track of the resist solution on the wafer W when the resist solution discharge nozzle N1 is moved from the peripheral portion B to the central portion C and a track of the resist solution on the wafer W when it is moved from the central portion C to the peripheral portion A can be matched, for example, like a track shown in FIG. 10. Consequently, a uniform resist film can be formed on the wafer W.

Figure 16:
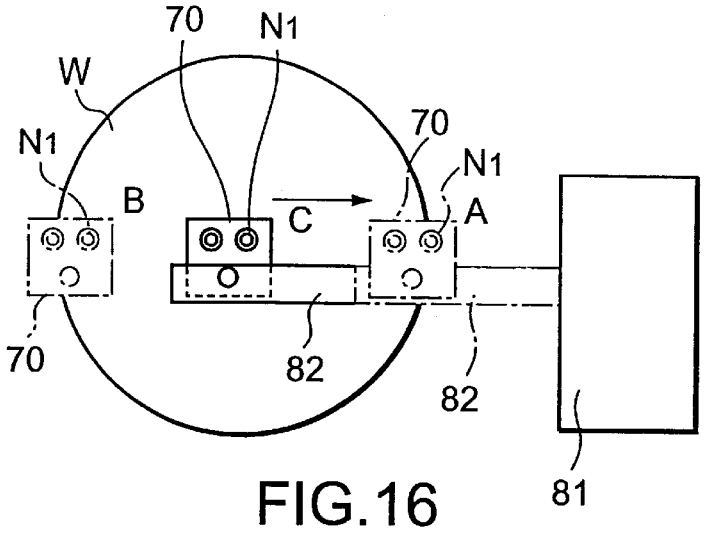
FIG. 16 is an explanatory view showing the state in FIG. 15 in plan view.
Figure 17:
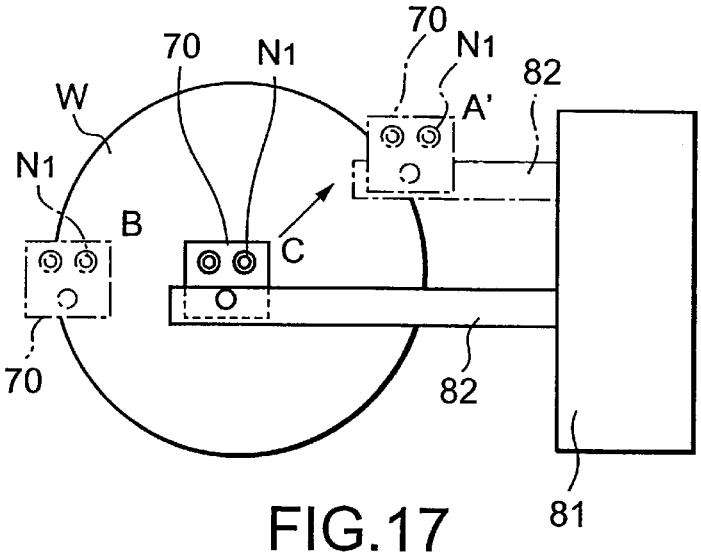
FIG. 17 is an explanatory view showing a state in which the resist solution discharge nozzle is moved to a peripheral portion which is not on the diameter of the wafer in plan view.

In the aforesaid embodiment, as shown in FIG. 16, a discharge start point of the resist solution is set at the peripheral portion B, and the nozzle holder 70 is moved on a straight line to the peripheral portion A which is a discharge stop point of the resist solution through the central portion C, that is, on a diameter of the wafer W. In place of the above, as shown in FIG. 17, it is suitable that a peripheral portion A' which is a discharge stop point of the resist solution is set at a point which is not on the diameter of the wafer w and that the nozzle holder 70 is moved thereto. Moreover, a discharge start point and a discharge stop point may be set at the same point. Specifically, it is suitable that the resist solution discharge nozzle N1 is moved back and forth at a constant speed between the peripheral portion B and the central portion C, the resist solution coating amount is gradually decreased during an outward journey, and the resist solution coating amount is gradually increased during its return.

Figure 18:
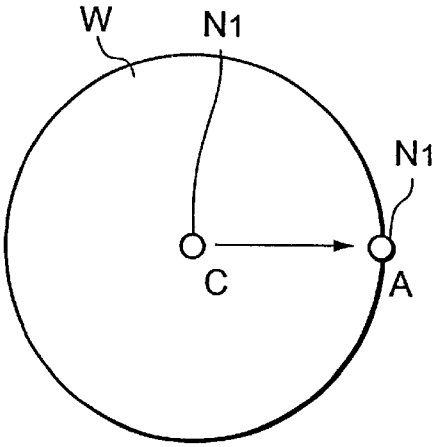
FIG. 18 is an explanatory view showing a track of the resist solution discharge nozzle when a discharge start point of the resist solution is set at the central portion of the wafer and a discharge stop point of the resist solution is set at the peripheral portion of the wafer respectively.
Figure 19:
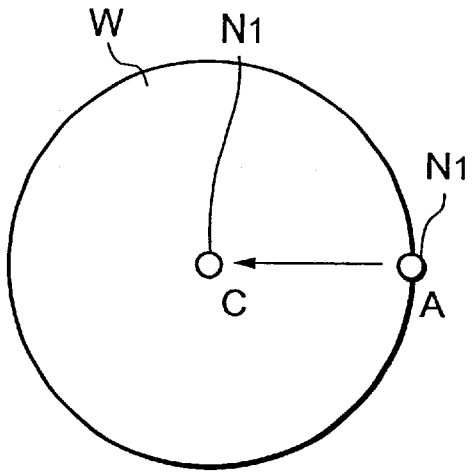
FIG. 19 is an explanatory view showing a track of the resist solution discharge nozzle when the resist solution is discharged continuously from the state in FIG. 18 and a discharge stop point of the resist solution is set at the central portion of the wafer.
Figure 20:
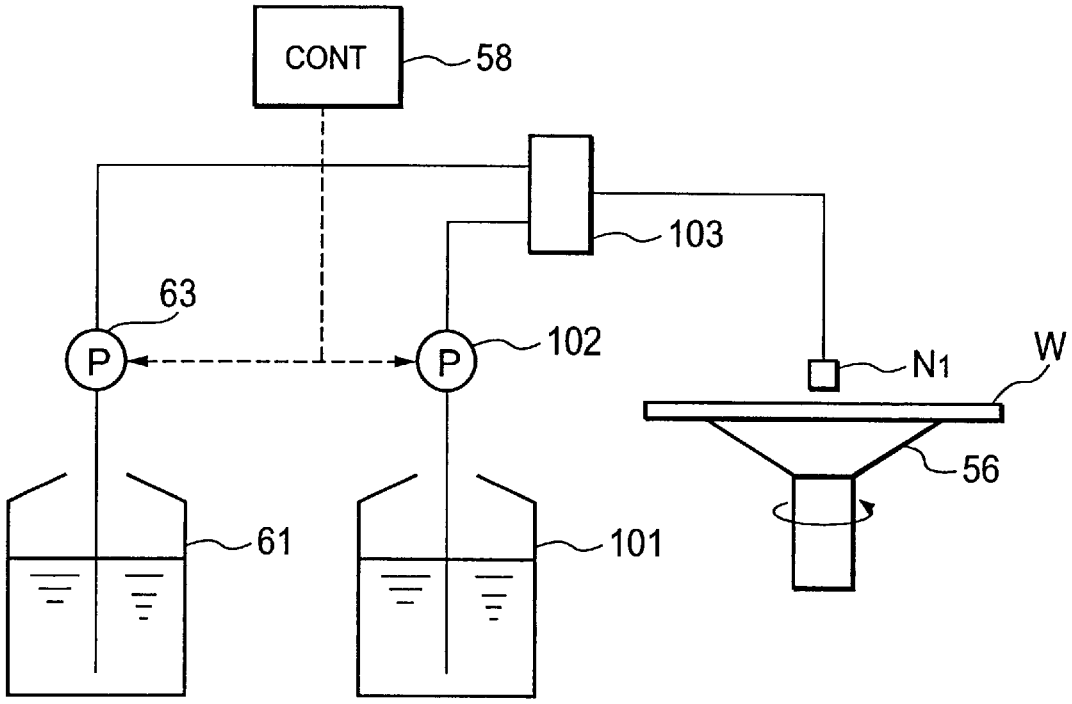
FIG. 20 is a view showing a structural example in which mixing amounts of the resist solution and a solvent can be varied.

The example in which the discharge of the resist solution is started at the peripheral portion B is explained in the aforesaid embodiment. It is suitable, however, that a discharge start point of the resist solution is set at the central portion C as shown in FIG. 18, the resist solution discharge nozzle N1 is moved from the central portion C to the peripheral portion A at a constant speed, the resist solution discharge amount from the resist solution discharge nozzle N1 is gradually increased during this movement, the resist solution discharge nozzle N1 is turned back at the peripheral portion A and moved to the central portion C at a constant speed as shown in FIG. 19, and the supply amount of the resist solution to be supplied to the wafer W is gradually decreased during this movement. In this case, the resist solution can be applied onto the wafer W so as to draw a spiral track twice, thereby further reducing coating unevenness of the resist solution.

It is also suitable that the resist solution supplied from the resist solution tank 61 via the pump 63 and a solvent supplied from a solvent tank 101 in which the solvent such as thinner is stored via a pump 102 are mixed by a mixer 103, and that the supply amount of the solvent from the solvent tank 101, that is, the mixing amount is changed according to the movement of the resist solution discharge nozzle N1, thereby changing viscosity of the resist solution to be applied onto the wafer W. Also in this case, finer control is possible in forming a uniform resist film on the wafer W in which case the mixing amount can be changed by controlling drive of the pumps 63 and 102 by the controller 58.

Further, the rotational speed of the wafer W while the resist solution discharge nozzle N1 is moved from the peripheral portion B to the peripheral portion A which is the resist solution discharge stop point may be controlled as shown in FIG. 21. Specifically, it is suitable that the resist solution discharge nozzle N1 is allowed to reach the maximum speed at a point D between the peripheral portion B and the central portion C, the rotational speed at this point in time is maintained during the movement from the point D to the central portion C, and that the rotational speed of the wafer W is thereafter gradually decreased while the resist solution discharge nozzle N1 is moved from the central portion C to the peripheral portion A.

An example of such rotational speed control of the wafer W will be explained based on FIG. 22 and FIG. 23. FIG. 22 shows transit points E, F, G, H, J, and K through which the resist solution discharge nozzle N1 passes on the wafer W, FIG. 23 shows the moving speed of the resist solution discharge nozzle N1 at the respective transit points. In this example, while the moving speed of the nozzle and the rotational speed of the wafer W are decreased like a quadratic function with respect to a distance of movement of the resist solution discharge nozzle N1, a fixed amount of the resist solution is discharged to the wafer W from the resist solution discharge nozzle N1 from the central portion C which is the resist solution discharge start point to the peripheral portion A which is the resist solution discharge stop point. Even if the rotational speed of the wafer W concurrently with the moving speed of the resist solution discharge nozzle N1 is controlled while a fixed amount of resist solution is applied to the wafer W, the coating amount of the resist solution per unit area for the wafer W is made fixed, thereby enabling the formation of a uniform resist film on the wafer W.

Figure 24:
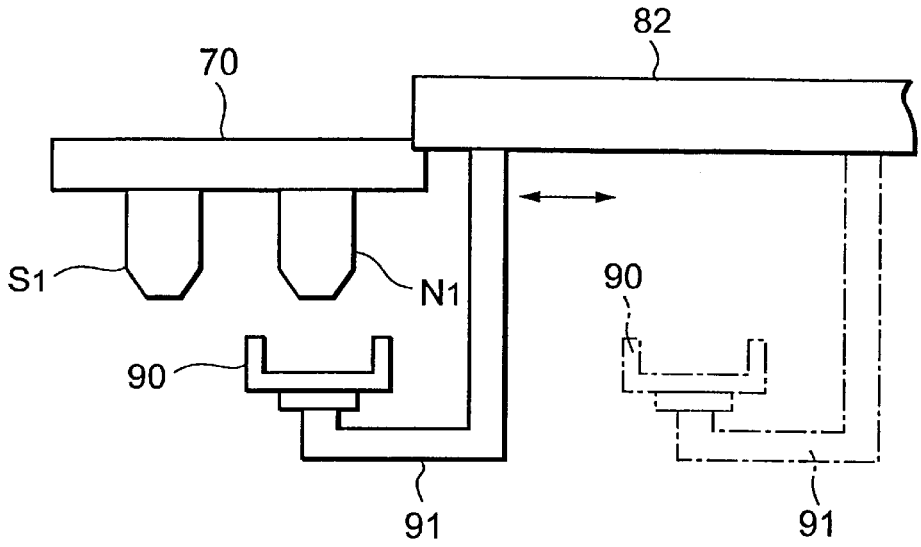
FIG. 24 is an explanatory view showing the structure of a catch member for catching the resist solution discharged from the resist solution discharge nozzle.

It is more preferable that a catch member 90 shown in FIG. 24 is provided in the resist coating unit 15 in order to embody the resist film forming method according to the aforesaid embodiments more appropriately.

As shown in FIG. 24, the catch member 90 is formed into a shape capable of catching the resist solution discharged from the resist solution discharge nozzle N1 to the wafer W, and supported by a moving member 91 movable in a lengthwise direction of the scan arm 82 by drive of a motor (not illustrated) or the like. The catch member 90 is structured to be movable along the lengthwise direction of the scan arm 82 between a predetermined position shown by a full line in FIG. 24 which is located vertically below the resist solution discharge nozzle N1 and a waiting position shown by an alternate long and short dash line.

Figure 25:
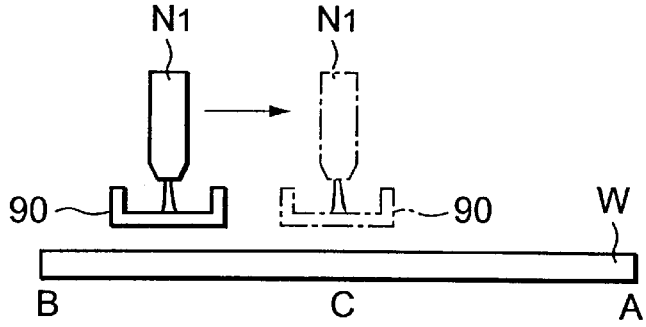
FIG. 25 is an explanatory view showing the positional relation between the resist solution discharge nozzle and the catch member in FIG. 24 while the resist solution discharge nozzle is moved from the peripheral portion of the wafer to the central portion of the wafer which is a discharge start point of the resist solution.
Figure 26:
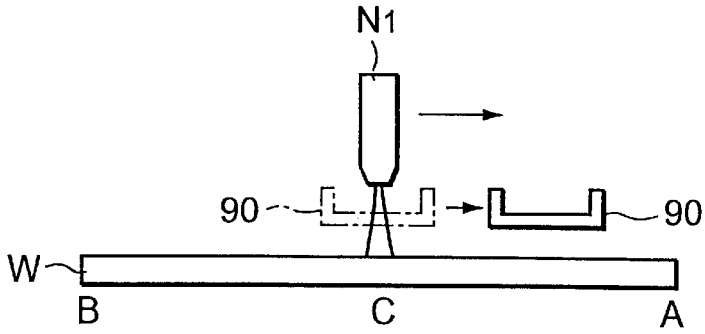
FIG. 26 is an explanatory view showing a state in which discharge of the resist solution is started at the central portion of the wafer which is a discharge start point of the resist solution and the positional relation to the catch member in FIG. 24 in this state.
Figure 27:
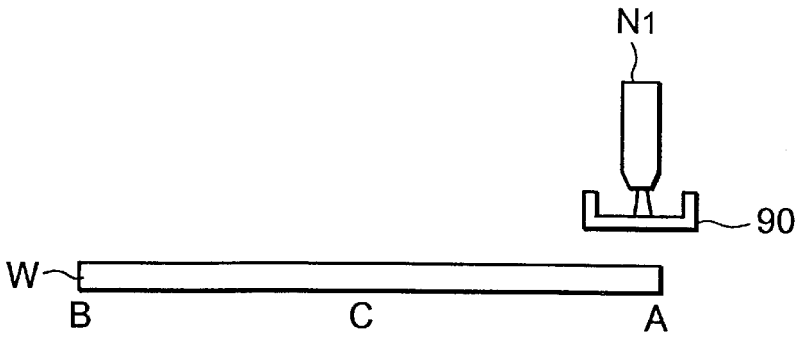
FIG. 27 is an explanatory view showing the positional relation between the resist solution discharge nozzle and the catch member in FIG. 24 when the resist solution is applied as far as the peripheral portion of the wafer.

According to the resist coating unit 15 including the catch member 90 having the aforesaid structure, when a method in which, for example, a resist solution discharge start point is set at the central portion C, a resist solution discharge stop point is set at the peripheral portion A, respectively, and the resist solution discharge nozzle N1 is moved while the speed thereof is gradually reduced is carried out, the start and stop of discharge of the resist solution are controlled by moving the catch member 90 as shown in FIG. 25 to FIG. 27.

Namely, first of all, when the resist solution discharge nozzle N1 is moved from the peripheral portion B shown by a full line in FIG. 25 to the position of the central portion C shown by an alternate long and two short dashes line in FIG. 25 while the speed thereof is being increased, the catch member 90 is located in a predetermined position, and the resist solution discharged from the resist solution discharge nozzle N1 is caught by the catch member 90. Thus, the resist solution discharged from the resist solution discharge nozzle N1 during this movement is not supplied to the wafer W.

Subsequently, when the resist solution discharge nozzle N1 passes over the central portion C, as shown in FIG. 26, the catch member 90 is moved from a predetermined portion shown by an alternate long and short dash line in FIG. 26 to a waiting position shown by a full line in FIG. 26. Thereby, the resist solution discharged from the resist solution discharge nozzle N1 is not caught by the catch ember 90 and is applied onto the wafer W.

Thereafter, while the resist solution discharge nozzle N1 is moved from the central portion C to the peripheral portion A while the speed thereof is being decreased, the resist solution is applied onto the wafer W. After the coating of the resist solution is completed as far as the peripheral portion A, the catch member 90 is moved to a predetermined position so that the resist solution discharged from the resist solution discharge nozzle N1 is caught again by the catch member 90 as shown in FIG. 27.

According to such a catch member 90, the movement of the catch member 90 between the waiting position and the predetermined position allows the coating of the resist solution for the wafer W to be started instantaneously and conversely allows the coating of the resist solution for the wafer W to be stopped instantaneously while the resist solution is being discharged from the resist solution discharge nozzle N1. Namely, in the case where the catch member 90 is moved as described above, responsiveness of coating of the resist solution for the wafer W can be improved more than in prior arts, as compared with the case where the start and stop of coating of the resist solution is controlled by the pump 63 which sends the resist solution to the resist solution discharge nozzle N1. Thus, in carrying out he aforesaid resist film forming method in the resist coating unit 15 including the catch member 90, the stop of coating of the resist solution at the peripheral portion A of the wafer W and the start of coating of the resist solution at the central portion C of the wafer W can be performed promptly, thereby enabling more suitable resist film formation than in prior arts.

Further, the resist solution caught by the catch member 90 can be reused, whereby the resist solution required for resist coating processing of the wafer W can be effectively utilized without waste. The use of the resist coating unit 15 including such a catch member 90 makes it possible to preferably embody the resist film forming method according to the present invention.

Next, another embodiment of the present invention will be explained.

Figure 28:
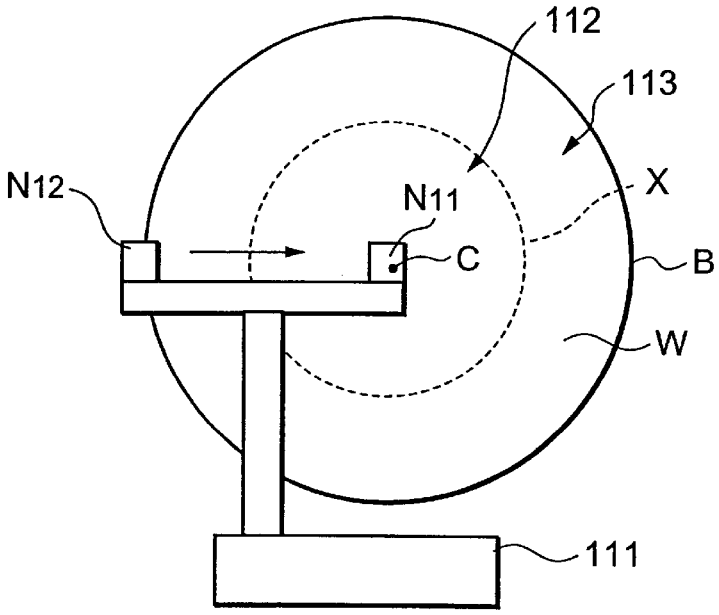
FIG. 28 is a view showing a structural example of an embodiment in which two resist solution discharge nozzles are provided.

As shown in FIG. 28, a first resist solution discharge nozzle N11 and a second resist solution discharge nozzle N12 are used as resist solution discharge nozzles in this embodiment.

The wafer W is rotated while being suction-held by the spin chuck 56. The first resist solution discharge nozzle N11 and the second resist solution discharge nozzle N12 are disposed above the wafer W. The first resist solution discharge nozzle N11 and the second resist solution discharge nozzle N12 are movable similarly in the radial direction of the wafer W by means of a common drive system 111. It should be mentioned that the first resist solution discharge nozzle N11 and the second resist solution discharge nozzle N12 may be movable respectively by separate drive systems.

The first resist solution discharge nozzle N11 is used for supplying the resist solution to a fist area 112 ranging from the central portion C of the rotating wafer W to a predetermined turning radius X. The second resist solution discharge nozzle N12 is used for supplying the resist solution to a second area 113 ranging from the predetermined turning radius X to the peripheral portion B of the wafer W outside the predetermined turning radius X.

In an initial condition, the first resist solution discharge nozzle N11 is located in the central portion C of the wafer W, and the second resist solution discharge nozzle N12 is located in the peripheral portion B of the wafer W. The discharge of resist solutions respectively from the first resist solution discharge nozzle N11 and the second resist solution discharge nozzle N12 onto the wafer W is started in this condition. The first resist solution discharge nozzle N11 and the second resist solution discharge nozzle N12 are moved in the radial direction of the wafer W, that is, the first resist solution discharge nozzle N11 is moved from the central portion C of the wafer W in the direction of the predetermined turning radius X, and the second resist solution discharge nozzle N12 is moved from the peripheral portion B of the wafer W in the direction of the predetermined turning radius X. During this movement, the resist solution discharged from the first resist solution discharge nozzle N11 is gradually increased, and the resist solution discharged form the second resist solution discharge nozzle N12 is gradually decreased, which makes the resist solution supplied onto the wafer W uniform.

Especially in this embodiment, processing time to supply the resist solution can be shortened by providing a plurality of nozzles.

Next, still another embodiment of the present invention will be explained.

Figure 29:
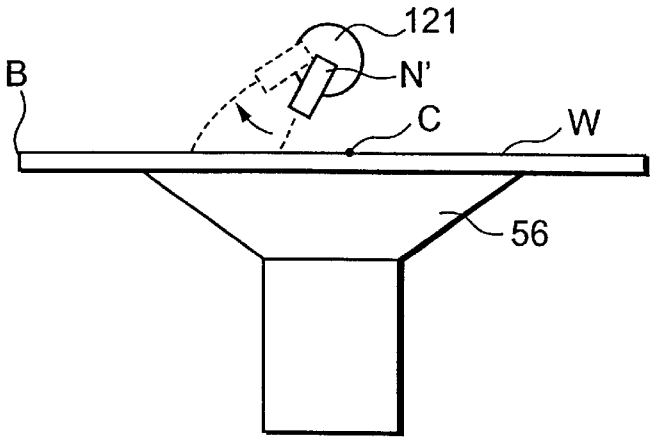
FIG. 29 is a view showing a structural example of an embodiment in which a variable mechanism for varying an angle formed by the resist solution discharge nozzle and the wafer is provided.

In this embodiment, as shown in FIG. 29, a resist solution discharge nozzle N' and a variable mechanism 121 which can vary an angle formed by the resist solution discharge nozzle N' and the wafer W are disposed, for example, above the central portion C of the wafer W rotatably suction-held by the spin chuck 56.

By varying the angle formed by the resist solution discharge nozzle N' and the wafer W when the resist solution is supplied onto the wafer W, a position on the wafer W of the resist solution supplied from the resist solution discharge nozzle N' is moved, for example, from the central portion C to the peripheral portion B of the rotating wafer W.

Especially in this embodiment, the structure of the drive mechanism (the variable mechanism 121) can be made more compact.

Next, yet another embodiment of the present invention will be explained.

Figure 30:
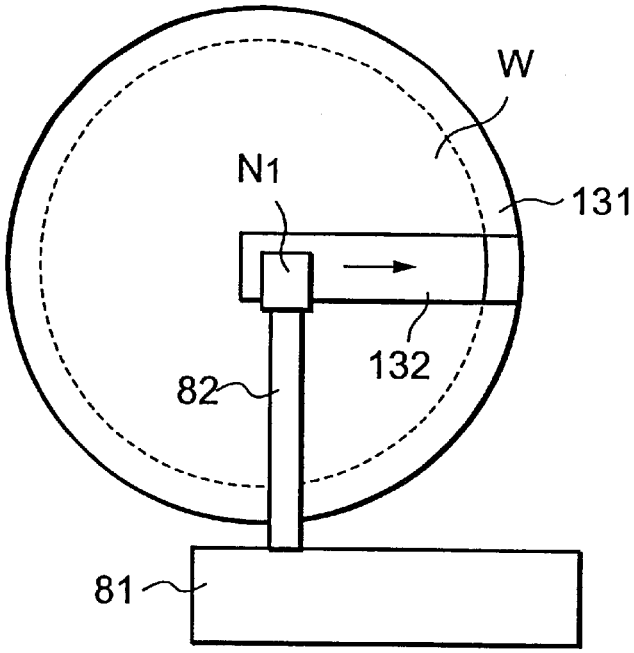
FIG. 30 is a plan view showing a structural example of an embodiment in which the resist solution is discharged to the wafer W from the resist solution discharge nozzle while a space over the wafer is covered with a cover.
Figure 31:
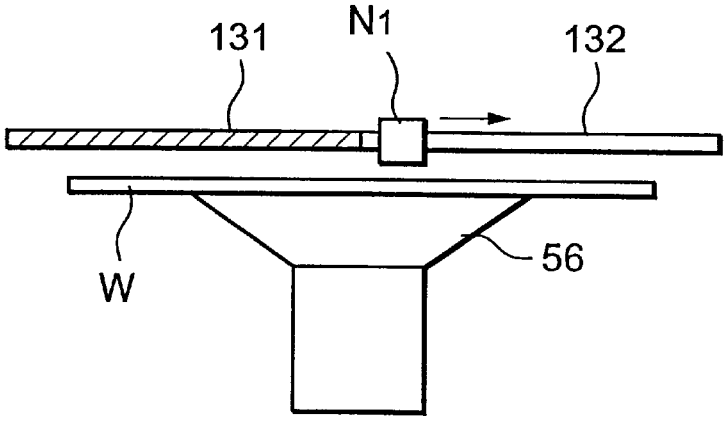
FIG. 31 is a front view of FIG. 30.

In this embodiment, as shown in FIG. 30 and FIG. 31, when the resist solution is supplied to the wafer W in the resist coating unit 15, the resist solution is discharged to the wafer W from the resist solution discharge nozzle N1 while a space over the wafer W is covered with a cover 131.

A cooling means such as a Peltier element or the like is provided here inside the cover 131, whereby atmosphere between the wafer W and the cover 131 is controlled to have a predetermined temperature. The aforesaid structure in which the resist solution is supplied to the wafer W in temperature-controlled atmosphere enables a film thickness of the resist applied to the wafer W to be more uniform.

Moreover, in the cover 131, a groove 132 is provided in the radial direction of the wafer W so that the resist solution discharge nozzle N1 can supply the resist solution to the wafer W.

A cooling means may be provided, for example, within the spin chuck 56 in order to perform such atmosphere control.

Usually, exhaust is continuously performed inside the resist coating unit 15. When the resist solution is supplied, the aforesaid atmosphere control can be performed more effectively by once stopping exhaust.

Incidentally, although both the moving speed of the nozzle and the rotational speed of the wafer W are controlled in the aforesaid first embodiment, it is necessary in this case to control the movement of the nozzle and the rotation of the wafer W in accurate timing. The following embodiment is a system example for carrying out such control.

Figure 32:
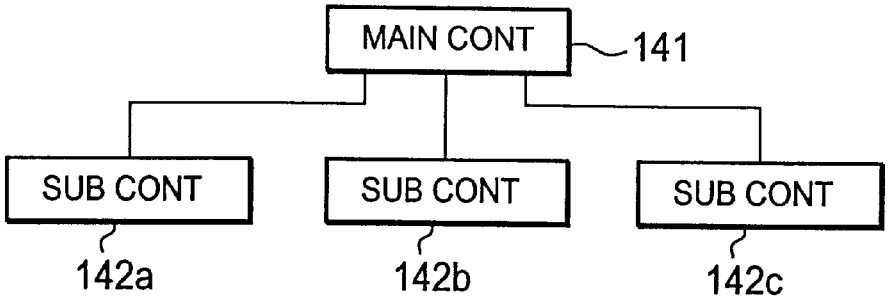
FIG. 32 is a system configuration example according to an embodiment having a step of performing a control performing step preferentially.

FIG. 32 is a configuration example of a control system of the coating and developing apparatus 1 shown in FIG. 1.

As shown in FIG. 32, in this control system, a plurality of sub-control sections 142*a*, 142*b*, and 142*c* are connected to a main control section 141. For example, the sub-control section 142*a* controls one resist coating unit 15, the sub-control section 142*b* controls the developing unit 16, and the sub-control section 142*c* controls the main transfer device 13. The other units are also controlled respectively by independent sub-control sections. The main control section 141 controls these sub-control sections collectively. In other words, while the main control section 141 controls the transfer of the wafer W by means of the main transfer device 13 in predetermined timing, for example, it also controls operation by the resist coating unit 15, whereby the wafer W is transferred from the main transfer device 13 to the resist coating unit 15 and the supply of the resist solution to the wafer W is performed. Such control is carried out by issuing a command from the main control section to each of the sub-control sections.

The movement of the resist solution discharge nozzle N1 and the rotation of the spin chuck 56 in the embodiment shown first need to be controlled, for example, as follows.

(1) The movement of the resist solution discharge nozzle N1 and the rotation of the spin chuck 56 are started, (2) if the rotational speed of the spin chuck 56 reaches 40 rpm when the moving speed of the resist solution discharge nozzle N1 is 35 mm/sec, within 10 msec, (3) the discharge of the resist solution from the resist solution discharge nozzle N1 is started, and the moving speed of the resist solution discharge nozzle N1 is decreased from 35 mm/sec to 20 mm/sec, and within 10 msec from arrival at this speed, (4) the rotational speed of the spin chuck 56 is decreased from 40 rpm to 25 rpm.

(5) When the resist solution discharge nozzle N1 is moved to the peripheral portion of the wafer W, the movement of the resist solution discharge nozzle N1 and the rotation of the spin chuck 56 are stopped.

Figure 33:
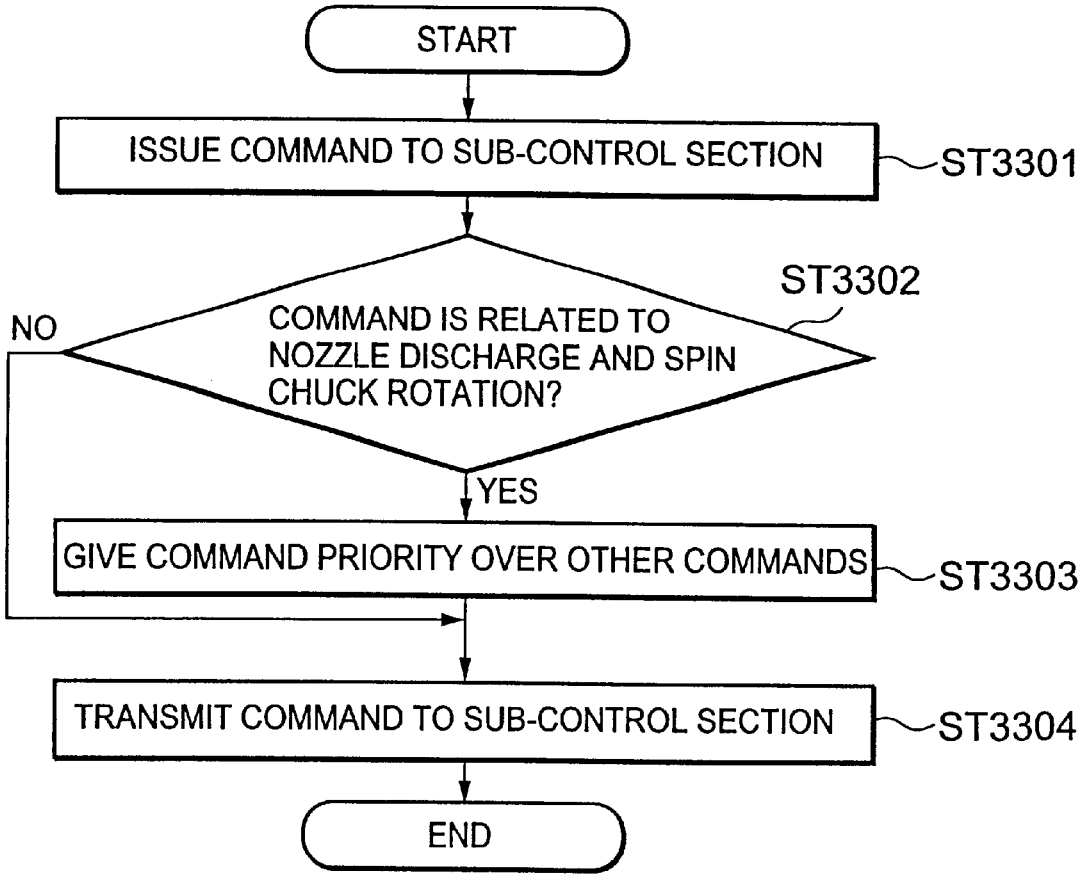
FIG. 33 is a flowchart showing operation of the system in FIG. 32.

As shown in FIG. 33, when a command is issued to each of the sub-control sections (step 3301), the main control section 141 determines whether or not the command is a command related to the movement of the resist solution discharge nozzle N1 and the rotation of the spin chuck 56 (the aforesaid (1) to (5), for example) (step 3302). When the command is related to the movement of the resist solution discharge nozzle N1 and the rotation of the spin chuck 56, taking priority over the other commands (step 3303), the command is transmitted to the sub-control section (step 3304).

According to this embodiment, the command related to the movement of resist solution discharge nozzle N1 and the rotation of the spin chuck 56 is preferentially transmitted as described above, which makes it possible to control the movement of the nozzle and the rotation of the wafer W in accurate timing.

Although the aforesaid embodiment is explained with the given example in which a resist film is formed on the wafer W, the present invention can be applied to a case where another processing solution film, for example, an inter-level insulation film, a polyimide film, a ferroelectric material film, or the like is formed on the wafer W. The present invention is more preferable to a thick film such as an inter-level isolation film.

Further, although the example in which the wafer W is used as a substrate is explained, the present invention can be applied to cases where other substrates such as an LCD substrate, a CD substrate, and the like are used.

As explained above, in the present invention, a supply amount of a processing solution per unit area with respect to the entire front surface of a substrate is made equal without rotating the substrate at a high speed, and thus a uniform processing solution film can be formed on the substrate. Consequently, the processing solution is not scattered from the substrate, thus attaining a decrease in processing solution and preventing contamination due to the scattered processing solution.

Further, the rotational speed of the substrate in addition to the supply amount of the processing solution to the peripheral portion and the central portion of the substrate and the moving speed of the nozzle is controlled in the present invention, thereby enabling finer control when the processing solution film is formed on the substrate.

Furthermore, the movement of the nozzle along the radial direction of the substrate is repeated in the present invention, thus eliminating unevenness of supply of the processing solution onto the substrate and enabling more certain formation of the uniform processing solution film.

Moreover, the viscosity of the processing solution in addition to the supply amount of the processing solution to the peripheral portion and the central portion of the substrate and the moving speed of the nozzle is controlled in the present invention, thereby enabling finer control when the processing solution film is formed on the substrate.

Besides, the processing solution discharged from the nozzle is caught by the catch member in the present invention, whereby the start and stop of supply of the processing solution to the substrate can be performed more promptly than in prior arts. Namely, responsiveness of the start and stop of supply of the processing solution is improved more than in prior arts. Moreover, the processing solution caught by the catch member can be reused, and hence the processing solution caught by the catch member can be used effectively.

The aforesaid embodiments have the intention of clarifying technical meaning of the present invention. Therefore, the present invention is not intended to be limited to the above concrete embodiments and to be interpreted in a narrow sense, and various changes may be made therein without departing from the spirit of the present invention and within the meaning of the claims.

What is claimed is:

1. A method for forming a film of a processing solution on a substrate, comprising the steps of:

rotating the substrate;

supplying the processing solution discharged from a nozzle onto the rotating substrate;

moving a position on the substrate of the processing solution to be supplied from the nozzle nearly in a radial direction of the rotating substrate; and gradually changing viscosity of the processing solution to be supplied to the substrate such that the processing solution to be supplied onto the substrate is uniform.

2. A method for forming a film of a processing solution on a substrate, comprising the steps of:

rotating the substrate;

supplying the processing solution discharged from a nozzle onto the rotating substrate;

moving a position on the substrate of the processing solution to be supplied from the nozzle by moving the nozzle nearly in a radial direction of the rotating substrate; and performing control for one of among the moving nozzle, rotational speed of the rotating substrate, and a supply amount of the processing solution to be supplied to the substrate, such that the processing solution to be supplied onto the substrate is uniform, and changing a diameter of the nozzle according to a kind of the processing solution.

3. A method for forming a film of a processing solution on a substrate, comprising the steps of:

rotating the substrate;

supplying the processing solution discharged from a nozzle onto the rotating substrate;

moving a position on the substrate of the processing solution to be supplied from the nozzle nearly in a radial direction of the rotating substrate; and performing control for one of among the moving nozzle, rotational speed of the rotating substrate, and a supply amount of the processing solution to be supplied to be substrate, such that the processing solution to be supplied onto the substrate is uniform, wherein in said processing solution supplying step, the processing solution discharged from the nozzle is supplied onto the rotating substrate while a space over the substrate is covered with a cover, and wherein in said processing solution supplying step, the processing solution discharged from the nozzle is supplied onto the rotating substrate while the temperature of the substrate is controlled by controlling the temperature of the cover.

4. A method for forming a film of a processing solution on a substrate, comprising the steps of:

rotating the substrate;

supplying the processing solution discharged from a nozzle onto the rotating substrate;

moving a position on the substrate of the processing solution to be supplied from the nozzle nearly in a radial direction of the rotating substrate; and performing control controlling one of among the moving nozzle, rotational speed of the rotating substrate, and a supply amount of the processing solution to be supplied to the substrate, such that the processing solution to be supplied onto the substrate is uniform, wherein in said moving step, the nozzle is moved along the radial direction from a first peripheral portion of the substrate to a second peripheral portion opposite to the first peripheral portion through a central portion of the substrate, and wherein in said rotating step, the substrate is rotated in a first direction while the nozzle is moved from the first peripheral portion to the central portion, and the substrate is rotated in a second direction which is a direction opposite to the first direction while the nozzle is moved from the central portion to the second peripheral portion.

5. An apparatus that supplies a processing solution discharged from a nozzle to a substrate and rotates the substrate to form a film of the processing solution on the substrate, comprising:

a catcher catches the processing solution discharged from a discharge port of the nozzle at a predetermined position below the discharge port; and a said that moves catcher between the predetermined position and a waiting position, wherein said catcher is moved with the nozzle.

6. An apparatus that supplies a processing solution discharged from a nozzle to a substrate and rotates the substrate to form a film of the processing solution on the substrate, comprising:

a cover that forms a space over the substrate while the processing solution discharged from the nozzle is supplied onto the rotating substrate, a groove provided in the cover in the radial direction of the substrate, and a temperature controller that controls a temperature of the cover.

* * * * *